US008307850B2

(12) United States Patent
Akiyama et al.

(10) Patent No.: US 8,307,850 B2
(45) Date of Patent: Nov. 13, 2012

(54) AIR INTAKE DEVICE FOR ENGINE

(75) Inventors: Hiroshige Akiyama, Miyagi (JP); Toshiyuki Sugimoto, Miyagi (JP)

(73) Assignee: Keihin Corporation, Tokyo (JP)

( * ) Notice: Subject to any disclaimer, the term of this patent is extended or adjusted under 35 U.S.C. 154(b) by 799 days.

(21) Appl. No.: 12/065,475

(22) PCT Filed: Aug. 16, 2006

(86) PCT No.: PCT/JP2006/316092

§ 371 (c)(1),
(2), (4) Date: Jun. 29, 2009

(87) PCT Pub. No.: WO2007/029459

PCT Pub. Date: Mar. 15, 2007

(65) Prior Publication Data

US 2009/0301570 A1 Dec. 10, 2009

(30) Foreign Application Priority Data

Sep. 2, 2005 (JP) ..... 2005-254706

(51) Int. Cl.
*F02M 1/02* (2006.01)

(52) U.S. Cl. ..... 137/601.17; 123/337; 123/339.1; 251/324; 251/333

(58) Field of Classification Search ..... 123/328, 123/337, 339.41–339.28; 137/487.5, 601.14, 137/601.17; 251/324, 333, 343, 347; 92/177
See application file for complete search history.

(56) References Cited

U.S. PATENT DOCUMENTS 4,378,767 A * 4/1983 Kobashi et al. ..... 123/339.26
4,438,049 A * 3/1984 Ammons ..... 261/42
5,497,746 A * 3/1996 Semence et al. ..... 123/339.27
2006/0065238 A1* 3/2006 Kure ..... 123/339.24

FOREIGN PATENT DOCUMENTS

GB 2099080 A * 12/1982
JP 2002-349396 A 12/2002
JP 2003-74444 A 3/2003

OTHER PUBLICATIONS

Machine Translation of JP 2003-74444, Published Mar. 12, 2003, Patentee Keihin Corporation.*

* cited by examiner

*Primary Examiner* — Craig Schneider
*Assistant Examiner* — R. K. Arundale
(74) *Attorney, Agent, or Firm* — Arent Fox LLP

(57) ABSTRACT

An air intake device for an engine is provided that includes a bypass (20) connected to an air intake path (2) while bypassing a throttle valve (5), and a bypass valve (V) for controlling the degree of opening of the bypass (20), the bypass valve (V) being formed from a tubular valve chamber (15) having its interior opening on the upstream side of the bypass (20) and having an inner face with a metering hole (16) opening toward the downstream side of the bypass (20), and a valve body (25) slidably but non-rotatably fitted into the valve chamber (15) and opening and closing the metering hole (16), wherein an inner face (A) of the valve chamber (15) on which the metering hole (16) opens and an outer face (B1) of the valve body (25) opposing the inner face (A) and covering the metering hole (16) are formed in the same shape so as to enable them to be in intimate contact with each other, and other inner (A) and outer faces (B2) of the valve chamber (15) and the valve body (25) are formed so that there is a gap (g) therebetween. This enables the valve body to be reliably in intimate contact with the inner side face of the valve chamber on which the metering hole opens while guaranteeing smooth sliding of the valve body in the valve chamber in the bypass, thus preventing leaked air from flowing into the metering hole.

3 Claims, 14 Drawing Sheets

AIR INTAKE DEVICE FOR ENGINE

CROSS-REFERENCE TO RELATED APPLICATION

This application is a National Stage entry of International Application No. PCT/JP2006/316092, filed Aug. 16, 2006, the entire specification claims and drawings of which are incorporated herewith by reference.

TECHNICAL FIELD

The present invention relates to an improvement of an air intake device for an engine, the air intake device including a throttle body having an air intake path, a throttle valve that is supported on the throttle body and that opens and closes the air intake path, a bypass connected to the air intake path while bypassing the throttle valve, and a bypass valve for controlling the degree of opening of the bypass, the bypass valve being formed from a tubular valve chamber having an interior thereof opening on the upstream side of the bypass and having an inner face with a metering hole opening toward the downstream side of the bypass, and a valve body that is slidably but non-rotatably fitted into the valve chamber and that opens and closes the metering hole.

BACKGROUND ART

Such an air intake device for an engine is already known, as disclosed in Patent Publication 1.

[Patent Publication 1] Japanese Patent Application Laid-open No. 2003-74444

DISCLOSURE OF INVENTION

Problems to be Solved by the Invention

In the conventional air intake device for an engine, as shown in a drawing, both the inner peripheral face of the valve chamber and the outer peripheral face of the valve body are formed as cylindrical faces. In this arrangement, since the radius of the outer peripheral face of the valve body is set slightly smaller than the radius of the inner peripheral face of the valve chamber in order to enable the valve body to slide in the valve chamber, although the valve body is drawn toward the metering hole side due to air intake negative pressure acting on the metering hole, the valve body cannot be in intimate contact with the entire inner side face of the valve chamber, there is a gap between the valve body and the inner face of the valve chamber at opposite ends in the sideways direction of the metering hole, and leaked air flowing through the metering hole via the gap causes a deviation in the bypass air intake volume that is to be controlled by the valve body. This tendency is particularly strongly exhibited when the valve body is fully closed or at a low degree of opening, or when the opening area of the metering hole is set large.

The present invention has been accomplished in the light of such circumstances, and it is an object thereof to provide an air intake device for an engine of the above type in which the valve body reliably makes intimate contact with the valve chamber inner side face having the metering hole opening thereon while guaranteeing smooth sliding of the valve body in the valve chamber, thus preventing leaked air from flowing into the metering hole and enabling the bypass air intake volume to be always accurately controlled by the valve body.

Means for Solving the Problems

In order to attain the above object, according to a first aspect of the present invention, there is provided an air intake device for an engine, comprising a throttle body having an air intake path, a throttle valve that is supported on the throttle body and that opens and closes the air intake path, a bypass connected to the air intake path while bypassing the throttle valve, and a bypass valve for controlling the degree of opening of the bypass, the bypass valve being formed from a tubular valve chamber having an interior thereof opening on the upstream side of the bypass and having an inner face with a metering hole opening toward the downstream side of the bypass, and a valve body that is slidably but non-rotatably fitted into the valve chamber and that opens and closes the metering hole, characterized in that one portion of the inner face of the valve chamber on which the metering hole opens and one portion of an outer face of the valve body opposing the one portion of the inner face and covering the metering hole are formed in the same shape so as to enable them to be in intimate contact with each other, and other portions of the inner and outer faces of the valve chamber and the valve body displaced in the peripheral direction to the opposite side to the one portions are formed so as to form a gap therebetween.

According to a second aspect of the present invention, in addition to the first aspect, an inner peripheral face of the valve chamber is formed as a cylindrical face, a first partial outer peripheral face of the valve body covering the metering hole is formed as an arc-shaped face having a radius of curvature that is the same as that of the inner peripheral face, and a second partial outer peripheral face of the valve body on the side opposite to the first partial outer peripheral face is formed as an arc-shaped face that is substantially concentric with the first partial outer peripheral face and has a radius of curvature that is smaller than the radius of curvature of the first partial outer peripheral face.

According to a third aspect of the present invention, in addition to the first aspect, an outer peripheral face of the valve body is formed as a cylindrical face, a first partial inner peripheral face of the valve chamber on which the metering hole opens is formed as an arc-shaped face with a radius of curvature that is the same as that of the outer peripheral face, and a second partial inner peripheral face of the valve chamber on the side opposite to the first partial inner peripheral face is formed as an arc-shaped face that is concentric with the first partial inner peripheral face and has a radius of curvature that is greater than the radius of curvature of the first partial inner peripheral face.

According to a fourth aspect of the present invention, in addition to the first aspect, an inner side face of the valve chamber on which the metering hole opens and an outer side face of the valve body facing the inner side face are formed as planes that make intimate contact with each other.

According to a fifth aspect of the present invention, in addition to any one of the first to fourth aspects, the metering hole is formed as a rectangle with two sides parallel to a sliding direction of the valve body.

Effects of the Invention

In accordance with the first aspect of the present invention, since one portion of the inner face of the valve chamber on which the metering hole opens, and one portion of the outer face of the valve body facing the one portion of the inner side face and covering the metering hole are formed in the same shape so that they can make intimate contact with each other, when the valve body is drawn toward the metering hole side due to air intake negative pressure acting on the metering hole from the bypass downstream side, the valve body can make intimate contact reliably with the one portion of the inner face of the valve chamber, thus preventing leaked air from flowing into the metering hole, and it is therefore possible to always accurately control the bypass air intake volume by the valve body even when the valve body is fully closed or at a low degree of opening or when the opening area of the metering hole is set large. Moreover, since other portions of the inner and outer faces of the valve chamber and the valve body that are displaced in the peripheral direction to the opposite side to the one portions are formed so that there is a gap therebetween, it is possible to guarantee smooth sliding of the valve body in the valve chamber.

In accordance with the second aspect of the present invention, since the inner peripheral face of the valve chamber is formed as a cylindrical face, and the first partial outer peripheral face, covering the metering hole, of the valve body is formed as an arc-shaped face having the same radius of curvature as that of the inner peripheral face, the inner peripheral face of the valve chamber and the first partial outer peripheral face of the valve body can be machined easily with high precision, they can easily and reliably make intimate contact with each other, and it is therefore possible to contribute to an improvement in the precision of control of the bypass air intake volume by the valve body.

Furthermore, since the second partial outer peripheral face, on the side opposite to the first partial outer peripheral face, of the valve body is formed as an arc-shaped face having a radius of curvature that is smaller than the radius of curvature of the first partial outer peripheral face, it is possible to easily obtain a gap between the valve body and the valve chamber inner peripheral face on the side opposite to the metering hole for guaranteeing smooth sliding of the valve body.

In accordance with the third aspect of the present invention, since the outer peripheral face of the valve body is formed as a cylindrical face, and the first partial inner peripheral face of the valve chamber on which the metering hole opens is formed as an arc-shaped face having the same radius of curvature as that of the outer peripheral face, the outer peripheral face of the valve body and the first partial inner peripheral face of the valve chamber can be machined easily with high precision, they can easily and reliably make intimate contact with each other, and it is therefore possible to contribute to an improvement in the precision of control of the bypass air intake volume by the valve body.

Furthermore, since the second partial inner peripheral face of the valve chamber, on the side opposite to the first partial inner peripheral face, is formed as an arc-shaped face having a radius of curvature that is greater than the radius of curvature of the first partial inner peripheral face, it is possible to easily obtain a gap between the valve body and the valve chamber inner peripheral face on the side opposite to the metering hole for guaranteeing smooth sliding of the valve body.

In accordance with the fourth aspect of the present invention, since the planar inner side face of the valve chamber on which the metering hole opens and the planar outer side face of the valve body, which faces the inner side face, make intimate contact, it is possible to accurately control the bypass air intake volume by the valve body and also prevent the valve body from rotating, and it is therefore unnecessary to provide special rotation-preventing means, thus contributing to a simplification of the structure.

In accordance with the fifth aspect of the present invention, the effective opening area of the metering hole can be controlled linearly in proportion to the sliding stroke of the valve body and, moreover, when the valve body is at a high degree of opening, since fast idle air can flow with a high flow rate, it can suitably be used in a large engine.

EXPLANATION OF REFERENCE NUMERALS AND SYMBOLS

1 Throttle body
2 Air intake path
5 Throttle valve
15 Valve chamber
20 Bypass
25 Bypass valve
A Inner peripheral face of valve chamber
A1 First partial inner peripheral face of valve chamber
A2 Second partial inner peripheral face of valve chamber
A3 Inside face of valve chamber
B Inner peripheral face of valve body
B1 First partial outer peripheral face of valve body
B2 Second partial outer peripheral face of valve body
B3 Outside face of valve body
g Gap

BEST MODE FOR CARRYING OUT THE INVENTION

Modes for carrying out the present invention are explained below by reference to preferred embodiments of the present invention shown in the attached drawings.

Embodiment 1

A first embodiment of the present invention shown in FIG. 1 to FIG. 9 is explained.

Figure 1:
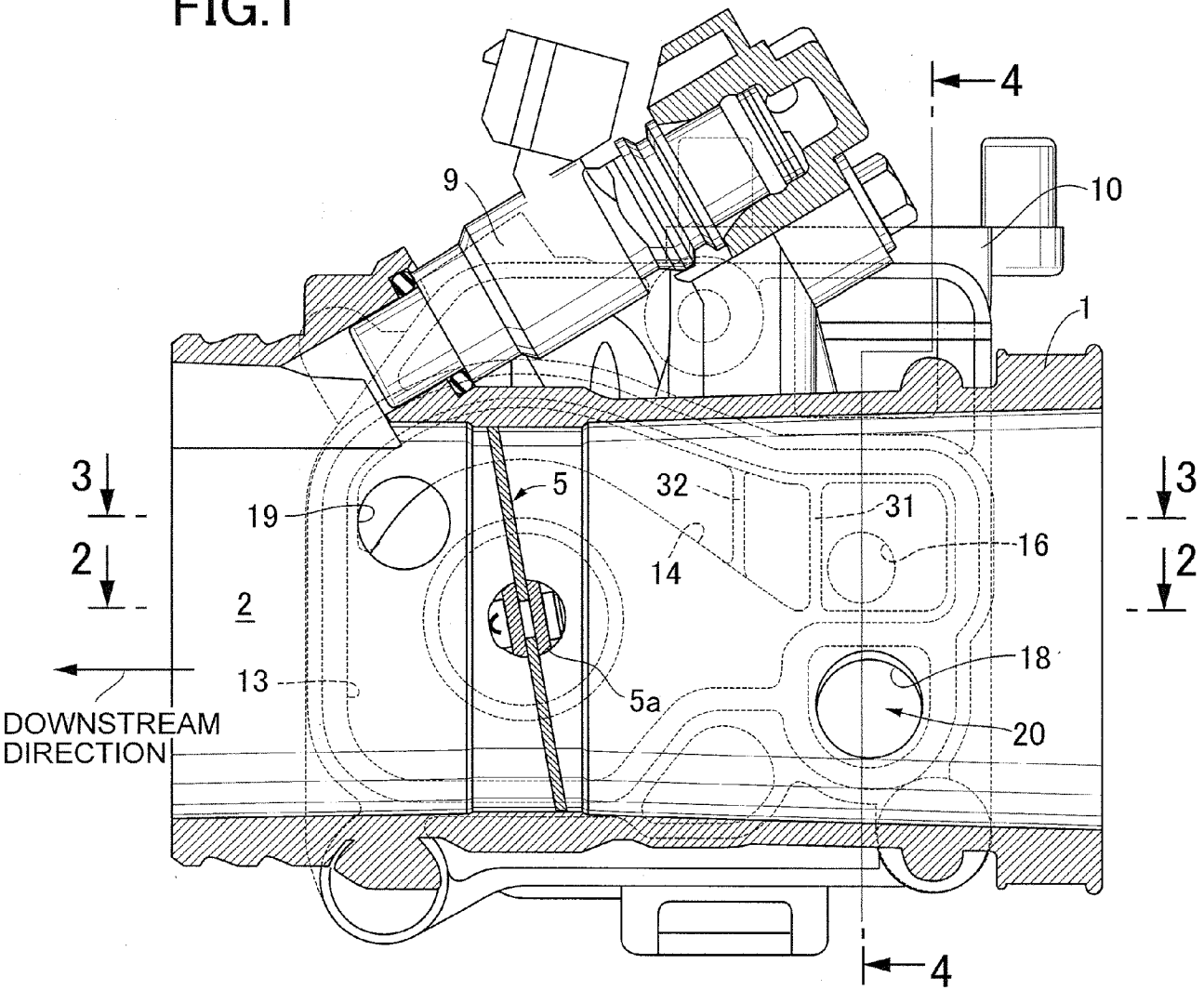
FIG. 1 is a sectional side view of an air intake device for an engine, related to the present invention (first embodiment).
Figure 2:
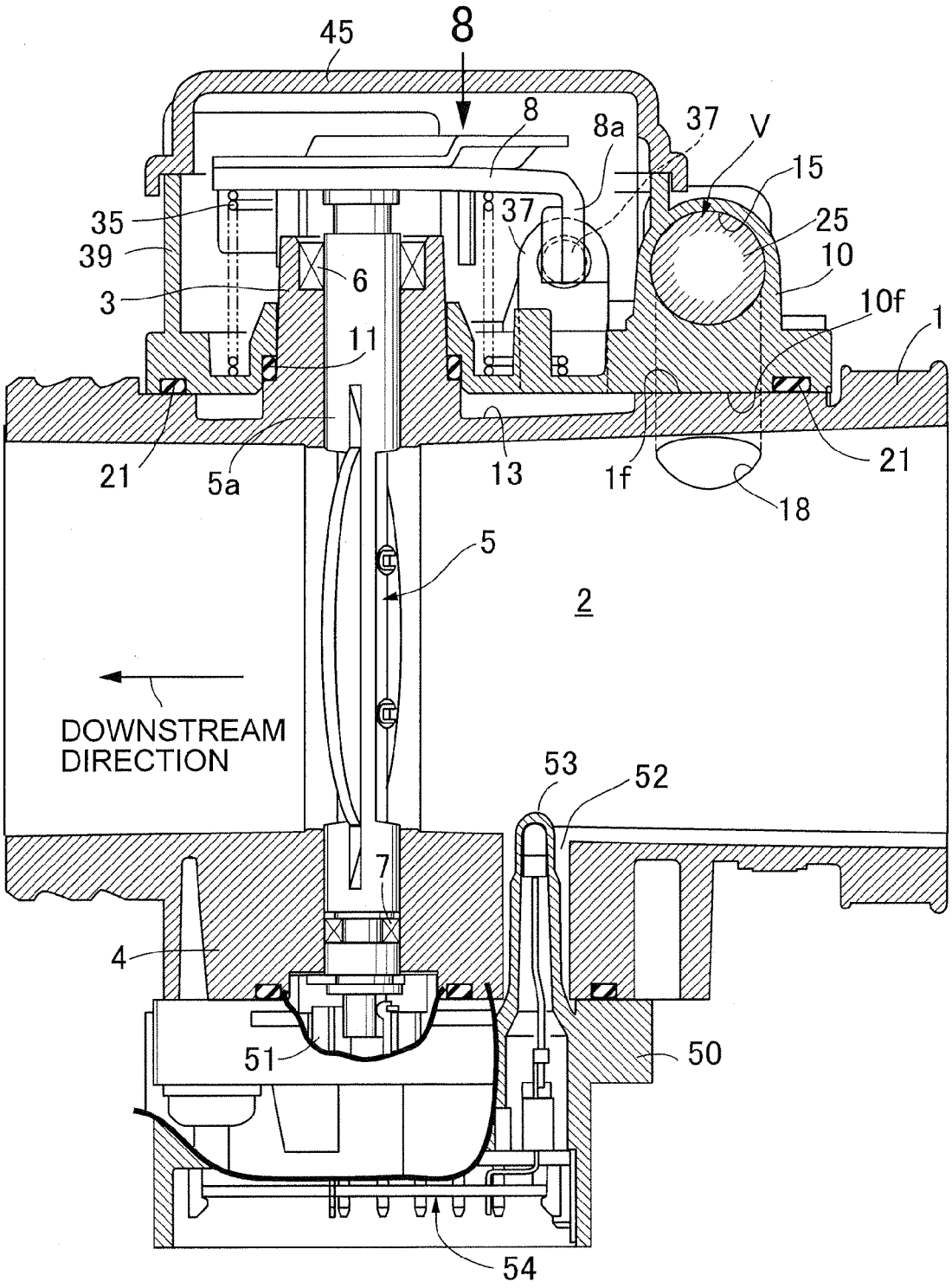
FIG. 2 is a sectional view along line 2-2 in FIG. 1 (first embodiment).
Figure 3:
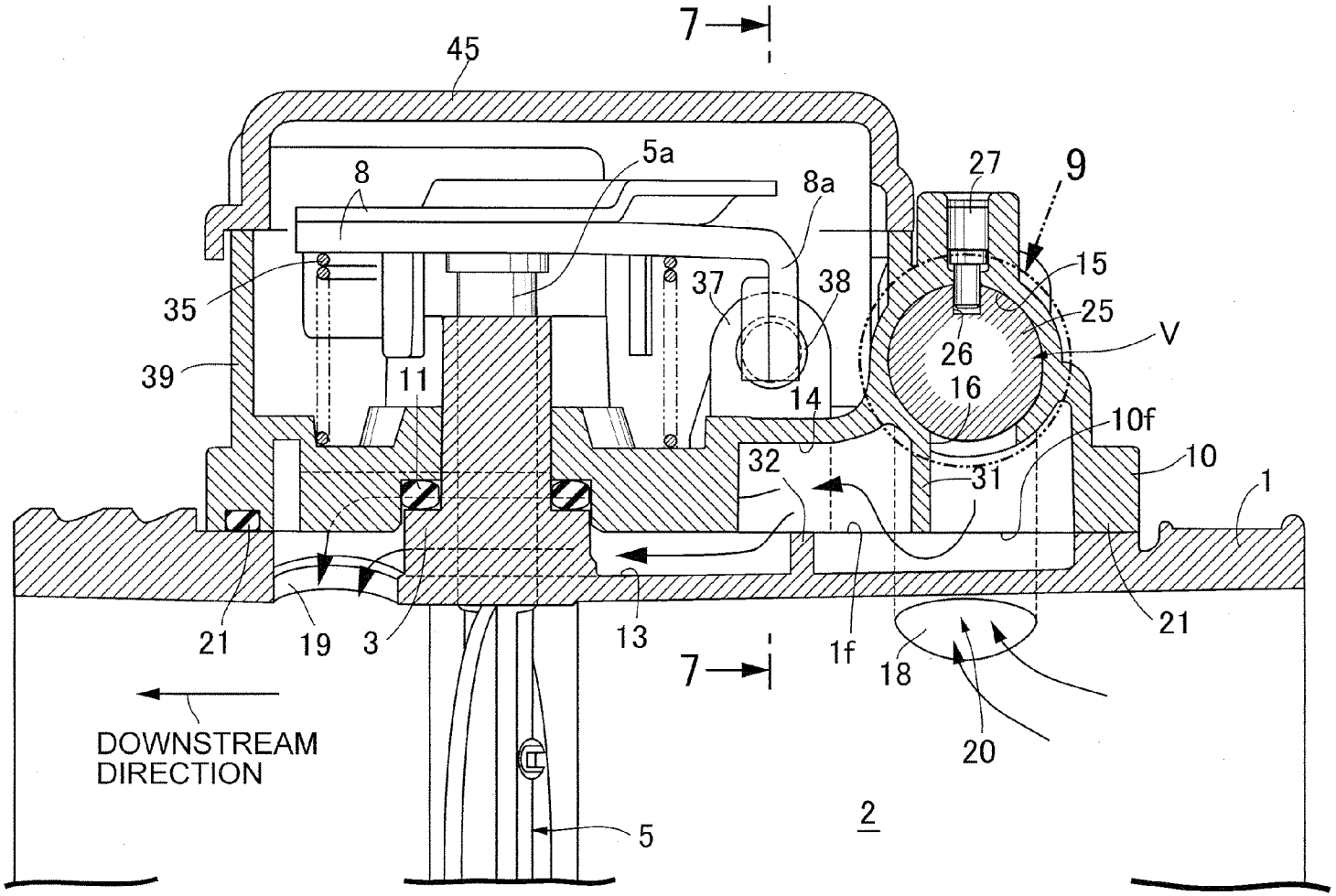
FIG. 3 is a sectional view along line 3-3 in FIG. 1 (first embodiment).

First, in FIG. 1 and FIG. 2, an air intake device for an engine of the present invention includes a throttle body 1 having a horizontal air intake path 2 communicating with an air intake port (not illustrated) of the engine. First and second bearing bosses 3 and 4 are formed in middle sections of opposing side walls of the throttle body 1 so as to project outward, a valve shaft 5*a* of a butterfly throttle valve 5 for opening and closing the air intake path 2 is rotatably supported by these bearing bosses 3 and 4, and the bearing bosses 3 and 4 are equipped with seals 6 and 7 respectively, which make intimate contact with the outer peripheral face of the valve shaft 5*a*. A throttle drum 8 is fixedly attached to one end portion of the valve shaft 5*a* projecting outward from the first bearing boss 3. Furthermore, a fuel injection valve 9 is mounted on an upper wall of the throttle body 1, the fuel injection valve 9 being capable of injecting fuel toward the air intake path 2 on the downstream side of the throttle valve 5.

As shown in FIG. 3 to FIG. 7, joined by a bolt to a side face of the throttle body 1 on the throttle drum 8 side is a bypass valve holder 10 extending around and fitted onto an outer periphery of the first bearing boss 3 via a seal 11, formed in a face 1*f* of the throttle body 1, opposing the bypass valve holder 10, is a groove-shaped first recess 13 surrounding the first bearing boss 3, and formed in a side face 10*f* of the bypass valve holder 10, opposing the throttle body 1, is a groove-shaped second recess 14 that passes above the first bearing boss 3 and is superimposed on an upper part of the first recess 13. Furthermore, formed in the bypass valve holder 10 are a vertically extending cylindrical valve chamber 15 and a circular metering hole 16 (see FIG. 1, FIG. 3, and FIG. 6) for providing communication between a vertically middle section of the valve chamber 15 and one end part of the second recess 14.

A lower end part of the valve chamber 15 communicates with the air intake path 2 on the upstream side of the throttle valve 5 via an inlet port 18 (see FIG. 1 and FIG. 4) formed from the throttle body 1 to the bypass valve holder 10. Furthermore, the other end part of the first recess 13 communicates with the air intake path 2 on the downstream side of the throttle valve 5 via an outlet port 19 (see FIG. 1, FIG. 3, and FIG. 5) formed from the throttle body 1 to the bypass valve holder 10. In this arrangement, the inlet port 18 and the outlet port 19 are disposed so that center lines thereof are parallel to the axis of the first bearing boss 3, 4. It is therefore possible to machine the throttle body 1 so as to coaxially form the inlet port 18, the outlet port 19, and a shaft hole of the first bearing boss 3, 4.

The inlet port 18, the valve chamber 15, the metering hole 16, the recesses 13 and 14, and the outlet port 19 thereby form a bypass 20 connected to the air intake path 2 while bypassing the throttle valve 5. A seal 21 is provided between the opposing faces 1*f* and 10*f* of the throttle body 1 and the bypass valve holder 10 so as to surround the recesses 13 and 14, the inlet port 18, and the outlet port 19.

Figure 4:
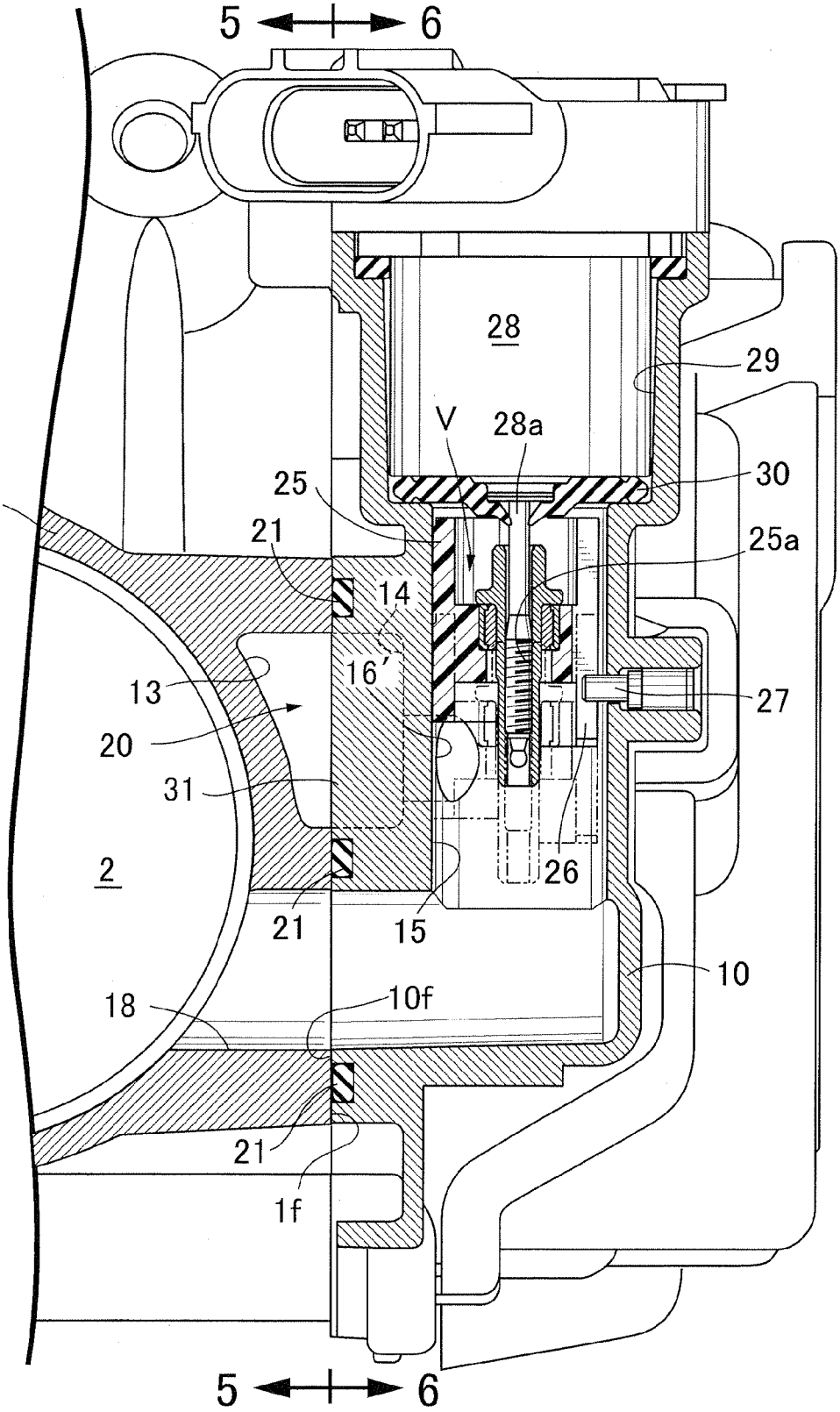
FIG. 4 is a sectional view along line 4-4 in FIG. 1 (first embodiment).
Figure 5:
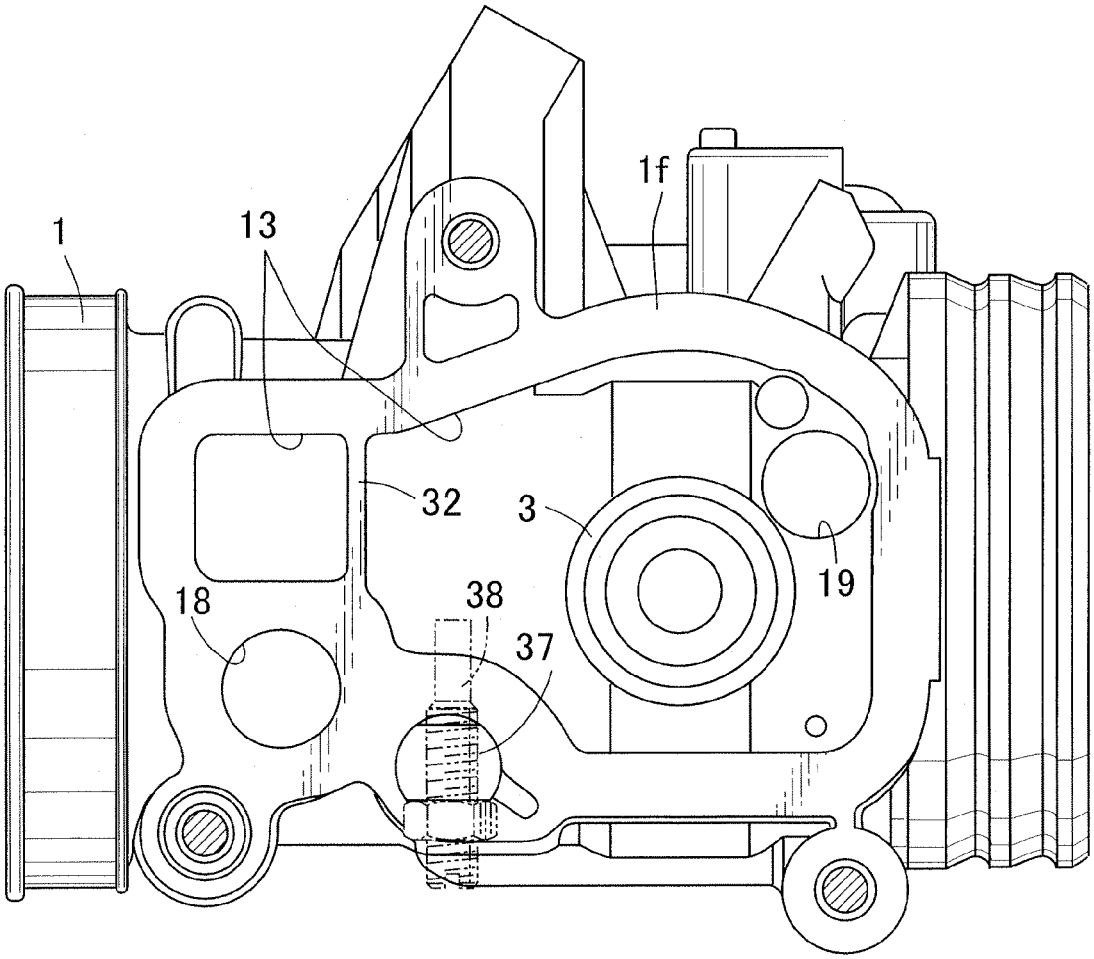
FIG. 5 is a sectional view along line 5-5 in FIG. 4 (first embodiment).
Figure 6:
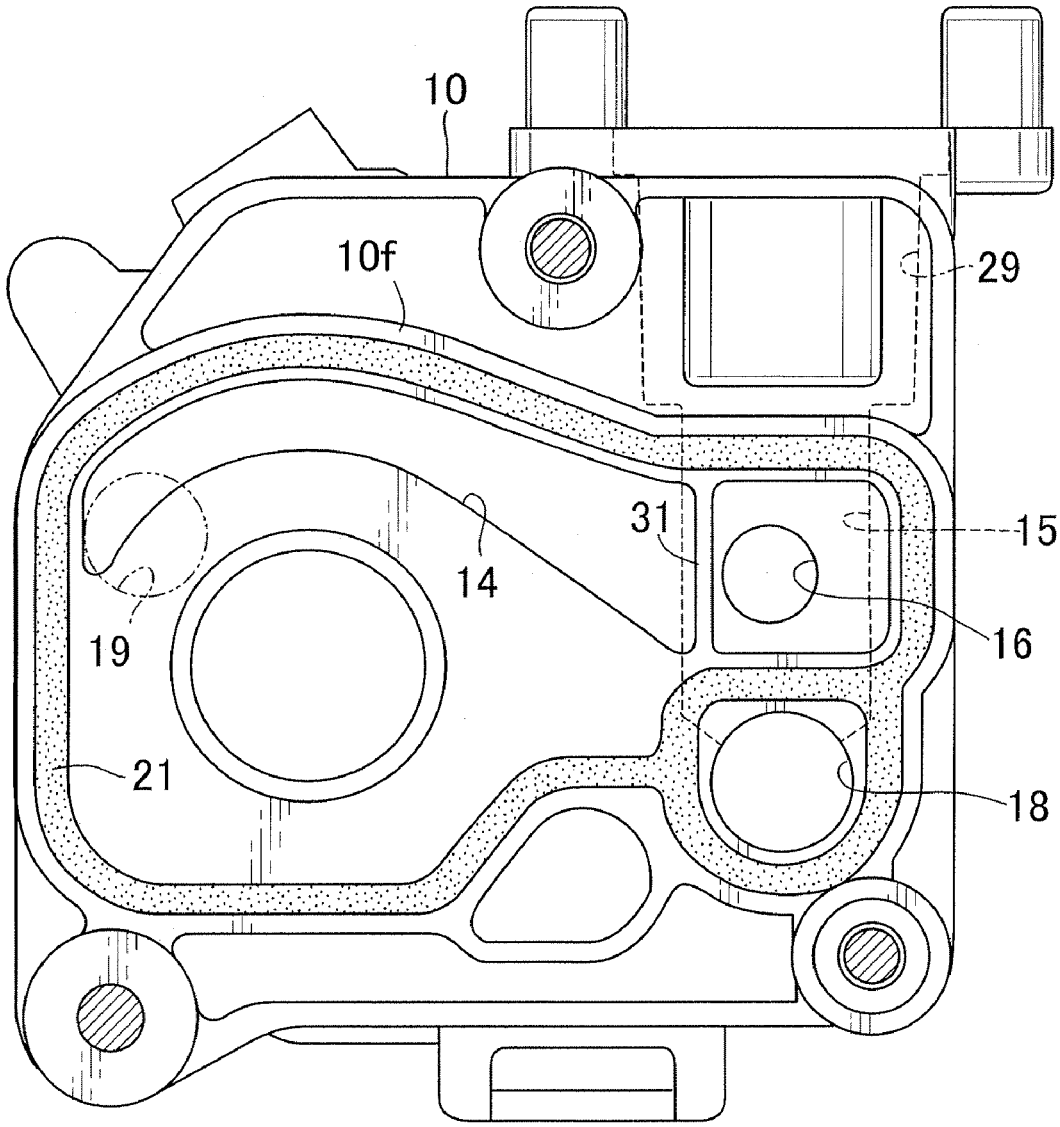
FIG. 6 is a sectional view along line 6-6 in FIG. 5 (first embodiment).
Figure 7:
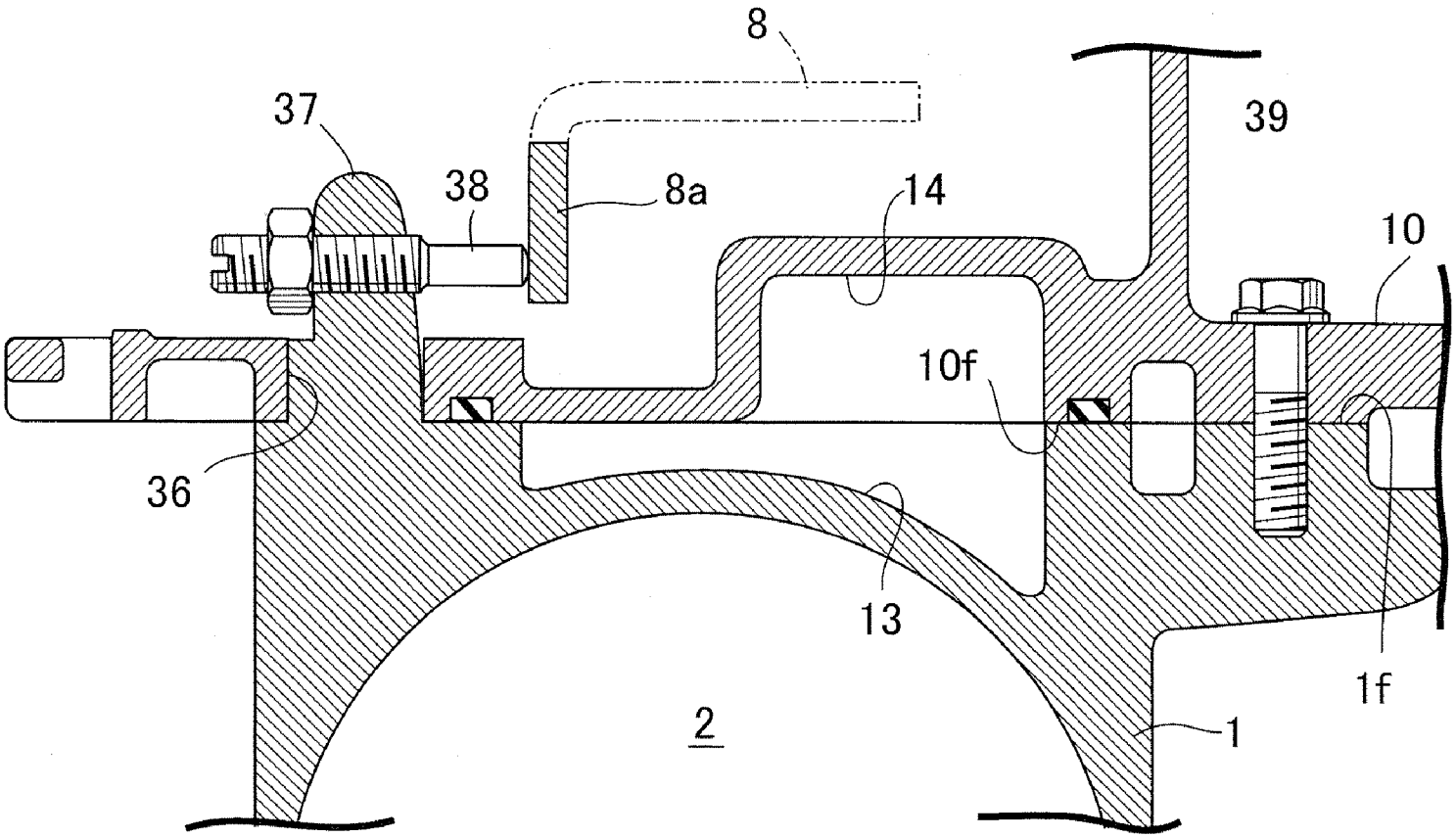
FIG. 7 is a sectional view along line 7-7 in FIG. 3 (first embodiment).

As clearly shown in FIG. 4, a piston-shaped valve body 25 for adjusting the degree of opening of the metering hole 16 from a fully closed state to a fully open state is slidably fitted into the valve chamber 15 from above, and in order to prevent the valve body 25 from rotating in this arrangement, a key 27 slidably engaging with a key groove 26 in the side face of the valve body 25 is mounted on the bypass valve holder 10. The valve body 25 and the valve chamber 15 thereby form a bypass valve V.

Formed in the bypass valve holder 10 is a mounting hole 29 communicating with the upper end of the valve chamber 15, and mounted in this mounting hole 29 is an electric actuator 28 for moving the valve body 25 for opening and closing. This electric actuator 28 has a downwardly projecting output shaft 28*a* screwed into a screw hole 25*a* in a center part of the valve body 25, and rotating the output shaft 28*a* forward and backward enables the valve body 25 to move up and down (open and close). A plate-shaped seal 30 is provided between a lower end face of the electric actuator 28 and a base face of the mounting hole 29, the seal 30 making intimate contact with an outer peripheral face of the output shaft 28*a*.

As shown in FIG. 1, FIG. 3, FIG. 5, and FIG. 6, a plurality (two in the illustrated example) of labyrinth walls 31 and 32 are formed on the throttle body 1 and the bypass valve holder 10 in a section where the first and second recesses 13 and 14 are superimposed upon each other, the labyrinth walls 31 and 32 being arranged alternately along the direction of flow of air while traversing the recesses 13 and 14.

Figure 8:
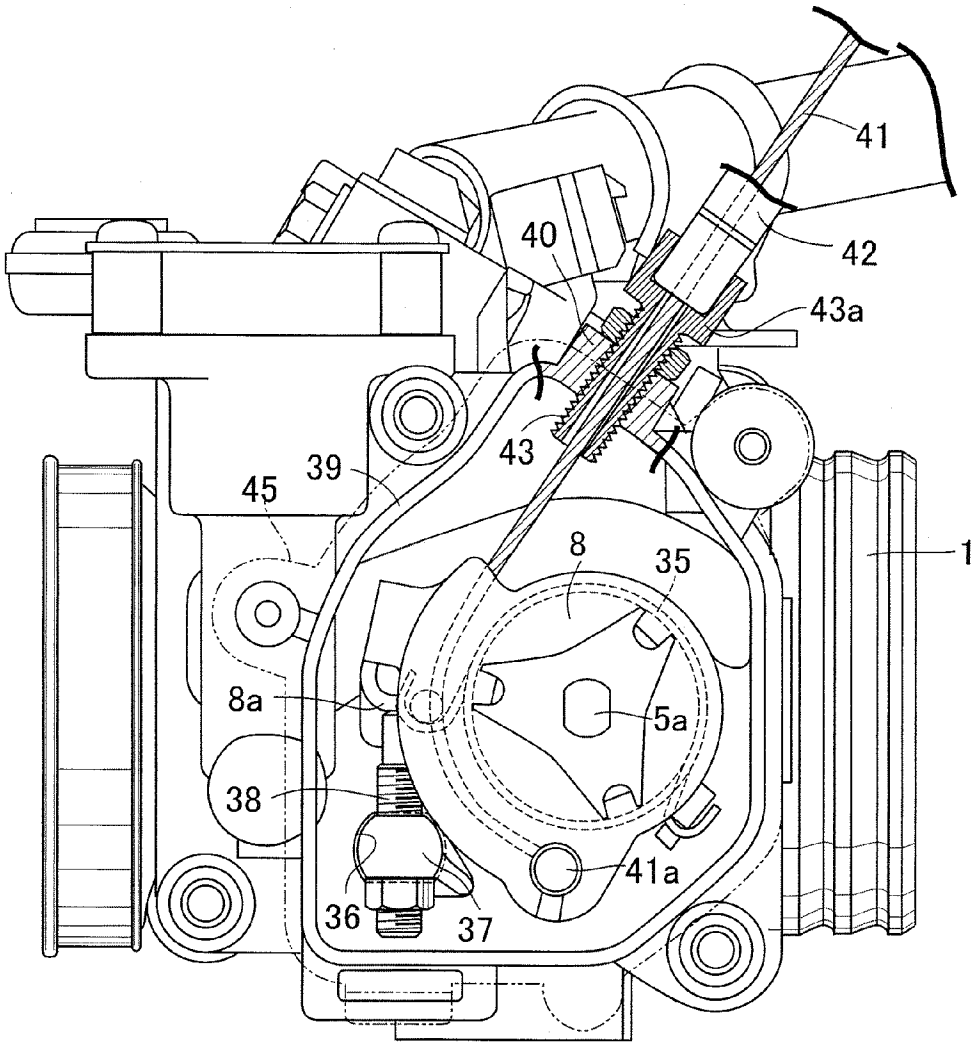
FIG. 8 is a view from arrow 8 in FIG. 2 (first embodiment).

In FIG. 2 and FIG. 8, a return spring 35, which is a torsion coil spring, urging the throttle drum 8 in a direction that closes the throttle valve 5 is mounted between the bypass valve holder 10 and the throttle drum 8 so as to surround the first bearing boss 3. Furthermore, a full closure regulation part 37 running through a through hole 36 of the bypass valve holder 10 and projecting toward the throttle drum 8 side is formed integrally with the throttle body 1, and a stopper bolt 38 adjustably screwed into a forward end part of the full closure regulation part 37 regulates a fully closed position of the throttle valve 5 by receiving a bent stopper piece 8*a* of the throttle drum 8.

Formed integrally with the bypass valve holder 10 is a tubular wall 39 surrounding the throttle drum 8 and being integrally equipped with a support boss 40 on one side, linked to the throttle drum 8 is a connection terminal 41*a* at one end of a throttle wire 41 running through the support boss 40, and linked to a throttle operation member such as a throttle grip (not illustrated) is a connection terminal at the other end of the throttle wire 41. A hollow bolt 43 through which the throttle wire 41 runs is adjustably screwed into the support boss 40, and an end part of a guide tube 42 slidably covering the throttle wire 41 is supported by a head portion 43*a* of the hollow bolt 43.

Pulling the throttle wire 41 by the throttle operation member enables the throttle valve 5 to be opened via the throttle drum 8, and releasing the pulling enables the throttle valve 5 to be closed by the urging force of the return spring 35.

A cover 45 for closing an open face of the tubular wall 39 is detachably retained on the tubular wall 39 by a screw.

Referring again to FIG. 2, a control block 50 covering an end face of the second bearing boss 4 is joined to the throttle body 1, and a throttle sensor 51 for detecting a degree of opening of the throttle valve 5 is formed between the control block 50 and the valve shaft 5*a*. Furthermore, provided in the control block 50 is a through hole 52 adjacent to the second bearing boss 4, and mounted on the control block 50 is a temperature sensor 53 running through the through hole 52 and having its forward end part facing the air intake path 2 on the upstream side of the throttle valve 5. Furthermore, mounted on the control block 50 is an electronic control unit 54 that receives detection signals from the throttle sensor 51, the temperature sensor 53, etc. and controls the operation of the electric actuator 28, the fuel injection valve 9, an ignition system, etc.

Figure 9:
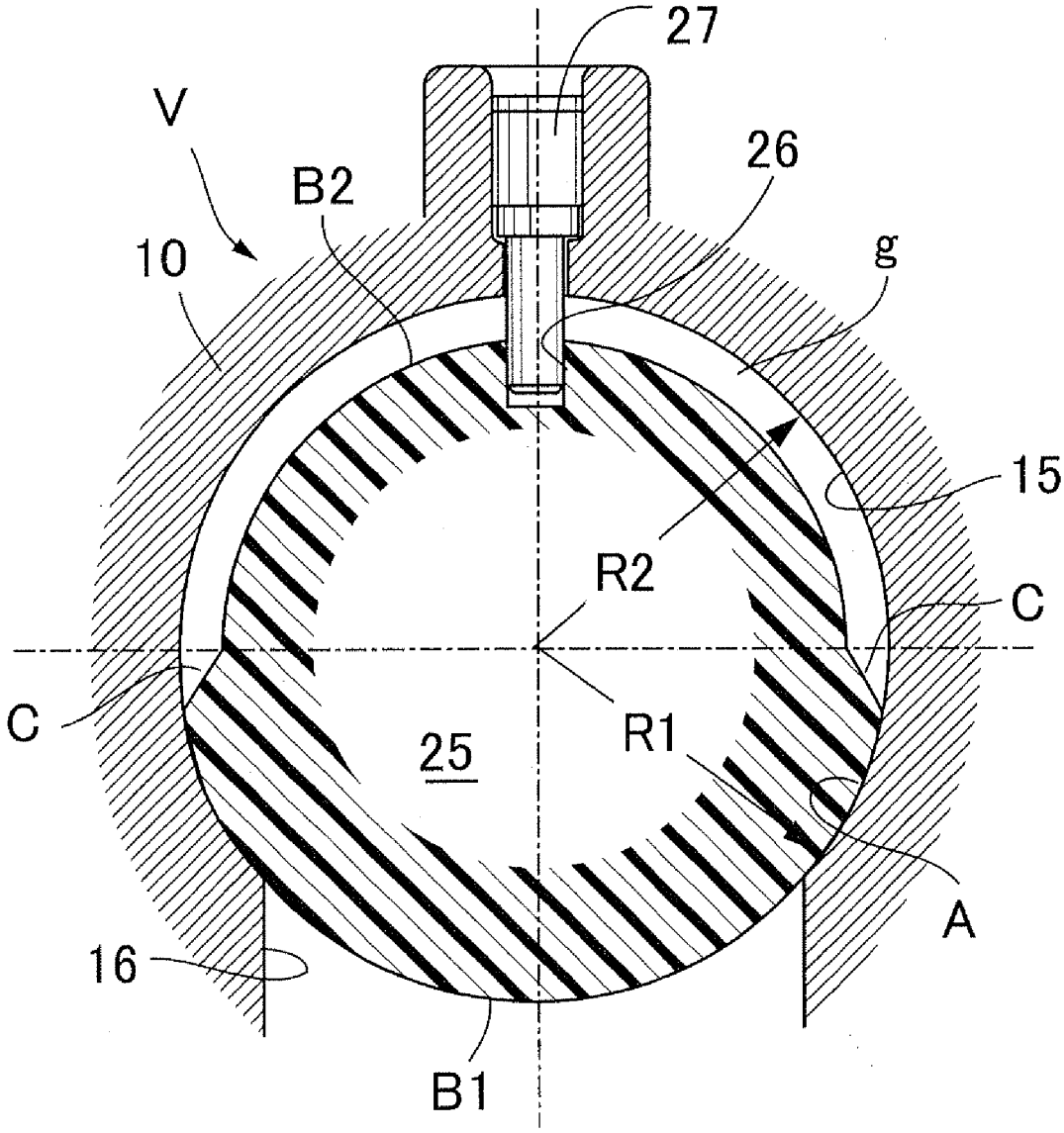
FIG. 9 is an enlarged view of part 9 in FIG. 3 (first embodiment).

In FIG. 9, the arrangement of the bypass valve V is explained in detail.

An inner peripheral face A of the valve chamber 15 is formed as a cylindrical face having a cross-section that is a perfect circle, and a first partial outer peripheral face B1, opposing the metering hole 16, of the valve body 25 is formed as a minor arc face with an angle of a little less than 180° and a radius of curvature R1 that is the same as the radius of curvature of the inner peripheral face A. In this way, the inner face of the valve chamber 15 on which the metering hole 16 opens and the outer face of the valve body 25 that is opposite the inner face and covers the metering hole 16 are formed in the same shape so that they can make intimate contact with each other.

Moreover, a second partial outer peripheral face B2 of the valve body 25 that is on the side opposite to the first partial outer peripheral face B1 is formed as an arc-shaped face having an angle of approximately 180°, the arc-shaped face being substantially concentric with the first partial outer peripheral face B1 and having a radius of curvature R2 that is smaller than the radius of curvature R1 of the first partial outer peripheral face B1. The first partial outer peripheral face B1 and the second partial outer peripheral face B2 are connected to each other by any plane or curved face. In this way, the inner peripheral face A of the valve chamber 15 and the first partial outer peripheral face B1 of the valve body 25 can be in intimate contact with each other, and in this intimately contacted state a gap g is formed between the inner peripheral face A of the valve chamber 15 and the second partial outer peripheral face B2 of the valve body 25.

In the illustrated example, the first and second partial outer peripheral faces B1 and B2 of the valve body 25 are formed concentrically, but these partial outer peripheral faces B1 and B2 may be slightly eccentric toward the metering hole 16 relative to each other.

The operation of this embodiment is now explained.

When the engine is running, the electronic control unit 54 supplies to the electric actuator 28 a current corresponding to an air intake temperature detected by the temperature sensor 53, thus operating the electric actuator 25 and thereby controlling the opening and closing of the valve body 25. When the engine is at a low temperature, that is, the engine is warming up, the valve body 25 is pulled up by a large amount, thus controlling the degree of opening of the metering hole 16 so that it is large. When the throttle valve 5 is in a fully closed state, the amount of fast idle air that is supplied to the engine through the bypass 20, that is, in sequence through the inlet port 18, the valve chamber 15, the metering hole 16, the first and second recesses 13 and 14, and the outlet port 19, is controlled so as to be relatively large by the degree of opening of the metering hole 16; at the same time an amount of fuel corresponding to the air intake temperature is injected from the fuel injection valve 9 toward the downstream side of the air intake path 2, and the engine receives a supply of the fast idle air and the fuel, thus maintaining an appropriate fast idling rotational speed so as to accelerate the warming up.

When the engine temperature increases as warming up progresses, since the electric actuator 28 accordingly makes the valve body 25 descend, thus decreasing the degree of opening of the metering hole 16, the amount of fast idle air supplied to the engine through the bypass 20 decreases, and the engine fast idling rotational speed decreases. When the engine temperature reaches a predetermined high temperature, since the electric actuator 28 maintains the valve body 25 at a predetermined degree of idle opening, the engine can be put into a normal idling state when the throttle valve 5 is fully closed.

As described above, the inner peripheral face A of the valve chamber 15 is formed as a cylindrical face, whereas in the valve body 25, the first partial outer peripheral face B1 opposing the metering hole 16 is formed as an arc-shaped face having an angle of a little less than 180° with the radius of curvature R1 that is the same as that of the inner peripheral face A; when the valve body 25 is withdrawn toward the metering hole 16 side by air intake negative pressure acting on the metering hole 16 from the downstream side of the bypass 20, the valve body 25 reliably makes the first partial outer peripheral face B1 opposing the metering hole 16 come into intimate contact with the inner peripheral face A of the valve chamber 15, thus preventing leaked air from flowing into the metering hole 16, and it is therefore possible to always accurately control the bypass air intake volume by the valve body 25 even when the valve body 25 is fully closed or at a low degree of opening, or when the opening area of the metering hole 16 is set large.

In particular, since the inner peripheral face A of the valve chamber 15 is formed as a cylindrical face, and the first partial outer peripheral face B1 of the valve body 25 is formed as an arc-shaped face having the same radius of curvature R1 as that of the inner peripheral face A, the inner peripheral face A of the valve chamber 15 and the first partial outer peripheral face B1 of the valve body 25 can be machined easily with high precision, and it is therefore possible to enhance the precision of control of the bypass air intake volume by the valve body 25.

Furthermore, since the second partial outer peripheral face B2 on the side opposite to the first partial outer peripheral face B1 is formed as an arc-shaped face having an angle of approximately 180°, the arc-shaped face being substantially concentric with the first partial outer peripheral face B1 and having the radius of curvature R2 that is smaller than the radius of curvature R1 of the first partial outer peripheral face B1, it is possible to easily form the gap g between the inner peripheral face A of the valve chamber 15 and the second partial outer peripheral face B2 of the valve body 25, thereby guaranteeing smooth sliding of the valve body 25 in the valve chamber 15.

Since the bypass 20 is formed so as to surround the first bearing boss 3, which supports the end part of the valve shaft 5*a* on the throttle drum 8 side, the space around the outer periphery of the first bearing boss 3, which is conventionally considered to be dead space, is utilized effectively for formation of the bypass 20, and it is therefore possible to make the overall air intake device compact while preventing the dimensions of the area around the throttle sensor 51 on the side opposite to the throttle drum 8 from increasing.

Furthermore, since at least one part of the bypass 20 is formed from the groove-shaped recesses 13 and 14 formed in opposing faces of the throttle body 1 and the bypass valve holder 10, which are joined to each other, even if the shape of the bypass 20 is complicated, at least one part thereof can be formed easily at the same time as molding the throttle body 1 and the bypass valve holder 10.

Moreover, since the center lines of the inlet port 18 and outlet port 19 of the bypass 20, which open on the air intake path 2, are parallel to the axis of the valve shaft 5*a*, it is possible to machine the throttle body 1 so as to coaxially form the inlet port 18 and the outlet port 19 and the shaft hole of the bearing boss, thereby contributing to a reduction in the number of machining steps.

Furthermore, since, in order to form the bypass 20, a plurality of labyrinth walls 31 and 32 are provided on the groove-shaped recesses 13 and 14 formed in the two opposing faces 1*f* and 10*f* of the throttle body 1 and the bypass valve holder 10, the labyrinth walls 31 and 32 being arranged alternately along the direction of flow of air while traversing the recesses 13 and 14, it is possible to simply form a labyrinth in the bypass 20, and even when the engine blows back and the blown back gas flows backward in the bypass 20, carbon contained in the gas can be trapped in the labyrinth, thus preventing carbon from entering the valve chamber 15.

Furthermore, since the full closure regulation part 37 running through the bypass valve holder 10 and projecting toward the throttle drum 8 side is formed integrally with the throttle body 1, and the fully closed position of the throttle valve 5 is regulated by means of the stopper bolt 38, which is screwed into the full closure regulation part 37, receiving the stopper piece 8*a* of the throttle drum 8, even if the bypass valve holder 10 is displaced relative to the throttle body 1 to some degree, the fully closed position of the throttle valve 5 can always be reproduced accurately regardless of the displacement.

Moreover, since the tubular wall 39 covering the outer periphery of the throttle drum 8 is formed integrally with the bypass valve holder 10, and the cover 45 is mounted on the open end of the tubular wall 39 so as to block it, the throttle drum 8 and the area around the shaft end of the valve shaft are covered in a substantially hermetically sealed manner by the tubular wall 39 of the bypass valve holder 10 and the cover 45, thus providing protection against dust and water therefor and, moreover, since the tubular wall 39 is formed on the bypass valve holder 10, it is possible to suppress any increase in the number of components and simplify the structure.

Furthermore, since the support boss 40 supporting the guide tube 42 of the throttle wire 41 is formed integrally with the tubular wall 39, the tubular wall 39, that is, the bypass valve holder 10, functions also as a support member for supporting the end part of the guide tube 42 of the throttle wire 41, thus reducing the number of components and the number of assembly steps.

Embodiment 2

Figure 10:
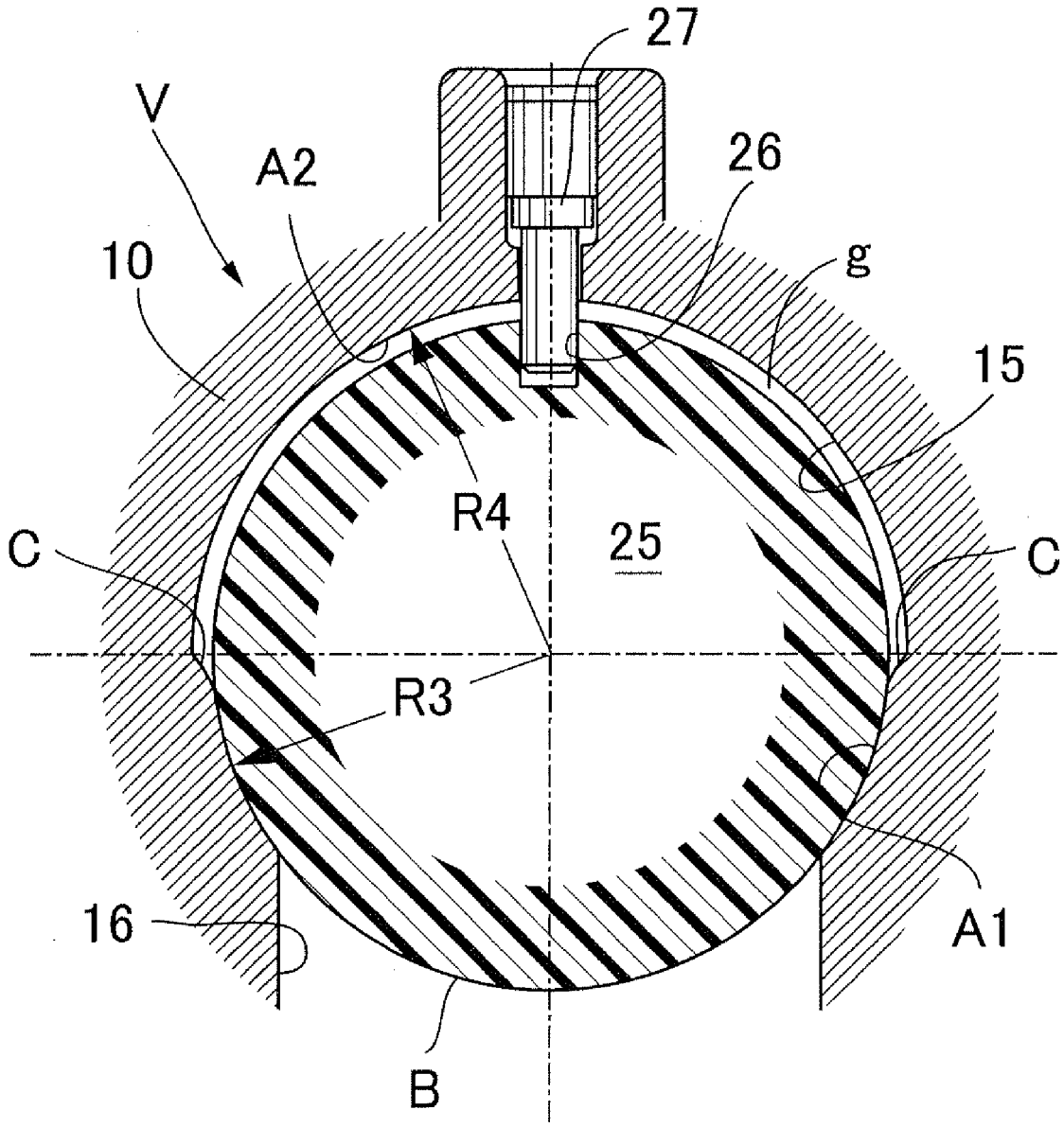
FIG. 10 is a view, corresponding to FIG. 9, showing a second embodiment of the present invention (second embodiment).

A second embodiment of the present invention is now explained by reference to FIG. 10.

An outer peripheral face B of a valve body 25 is formed as a cylindrical face having a cross-section that is a perfect circle with a radius R3. On the other hand, in a valve chamber 15, a first partial inner peripheral face A1, on which a metering hole 16 opens, is formed as a minor arc face with an angle of a little less than 180° and a radius of curvature R3 that is the same as the radius of curvature of the outer peripheral face B, and a second partial inner peripheral face A2 on the side opposite to the first partial inner peripheral face A1 is formed as an arc-shaped face with an angle of approximately 180° and a radius of curvature R4 that is greater than the radius of curvature R3 of the first partial inner peripheral face A1, the second partial inner peripheral face A2 being substantially concentric with the first partial inner peripheral face A1. The first partial inner peripheral face A1 and the second partial inner peripheral face A2 are connected to each other by any planes C and C or a curved face. In this way, the outer peripheral face B of the valve body 25 and the first partial inner peripheral face A1 of the valve body 25 can make intimate contact with each other, and in this intimately contacted state a gap g is formed between the outer peripheral face B of the valve body 25 and the second partial inner peripheral face A2 of the valve chamber 15.

In the illustrated example, the first and second partial inner peripheral faces A1 and A2 of the valve chamber 15 are formed concentrically, but these partial inner peripheral faces A1 and A2 may be slightly eccentric toward the metering hole 16 relative to each other. Since the arrangement is otherwise the same as that of the preceding embodiment, in FIG. 10 portions corresponding to the preceding embodiment are denoted by the same reference numerals and symbols, and duplication of the explanation is omitted.

In accordance with the second embodiment, since the outer peripheral face B of the valve body 25 is formed as a cylindrical face, and the first partial inner peripheral face A1 of the valve chamber 15 on which the metering hole 16 opens is formed as an arc-shaped face with an angle of a little less than 180° and the radius of curvature R3 that is the same as the radius of curvature of the outer peripheral face B, the outer peripheral face B of the valve body 25 and the first partial inner peripheral face A1 of the valve chamber 15 can be machined easily with high precision, and it is therefore possible to enhance the precision of control of the bypass air intake volume by the valve body 25.

Furthermore, by forming the second partial inner peripheral face A2 on the side opposite to the first partial inner peripheral face A1 as an arc-shaped face with an angle of approximately 180° and the radius of curvature R4 that is greater than the radius of curvature R3 of the first partial inner peripheral face A1, the second partial inner peripheral face A2 being substantially concentric with the first partial inner peripheral face A1, it is possible to obtain the gap g, which guarantees smooth sliding of the valve body 25, between the valve body 25 and the inner peripheral face of the valve chamber 15 on the side opposite to the metering hole 16.

Embodiment 3

A third embodiment of the present invention is now explained by reference to FIG. 11.

In a valve chamber 15, an inner side face A3 on which a metering hole 16 opens is formed as a plane, and the rest is an inner peripheral face A4 formed as a major arc with a radius of curvature R6. On the other hand, in a valve body 25, an outer side face B3 opposing the inner side face A3 and covering the metering hole 16 is also formed as a plane, and the rest is an outer peripheral face B4 formed as a major arc with a radius of curvature R5 that is smaller than the radius of curvature R6, the major arc being substantially concentric with the inner peripheral face A4.

In accordance with the third embodiment, intimate contact between the flat inner side face A3 of the valve chamber 15 and the flat outer side face B3 of the valve body 25 prevents leaked air from flowing into the metering hole 16 in the same manner as in the first and second embodiments; not only can the bypass air intake volume be controlled accurately by the valve body 25, but also rotation of the valve body 25 can be prevented, and unlike the preceding embodiment it is therefore unnecessary to provide rotation-preventing means for the valve body 25, that is, the key groove 26 or the key 27. Furthermore, it is possible to form a gap g between the inner peripheral face A4 of the valve chamber 15 and the outer peripheral face B4 of the valve body 25, thereby guaranteeing smooth sliding of the valve body 25.

Figure 11:
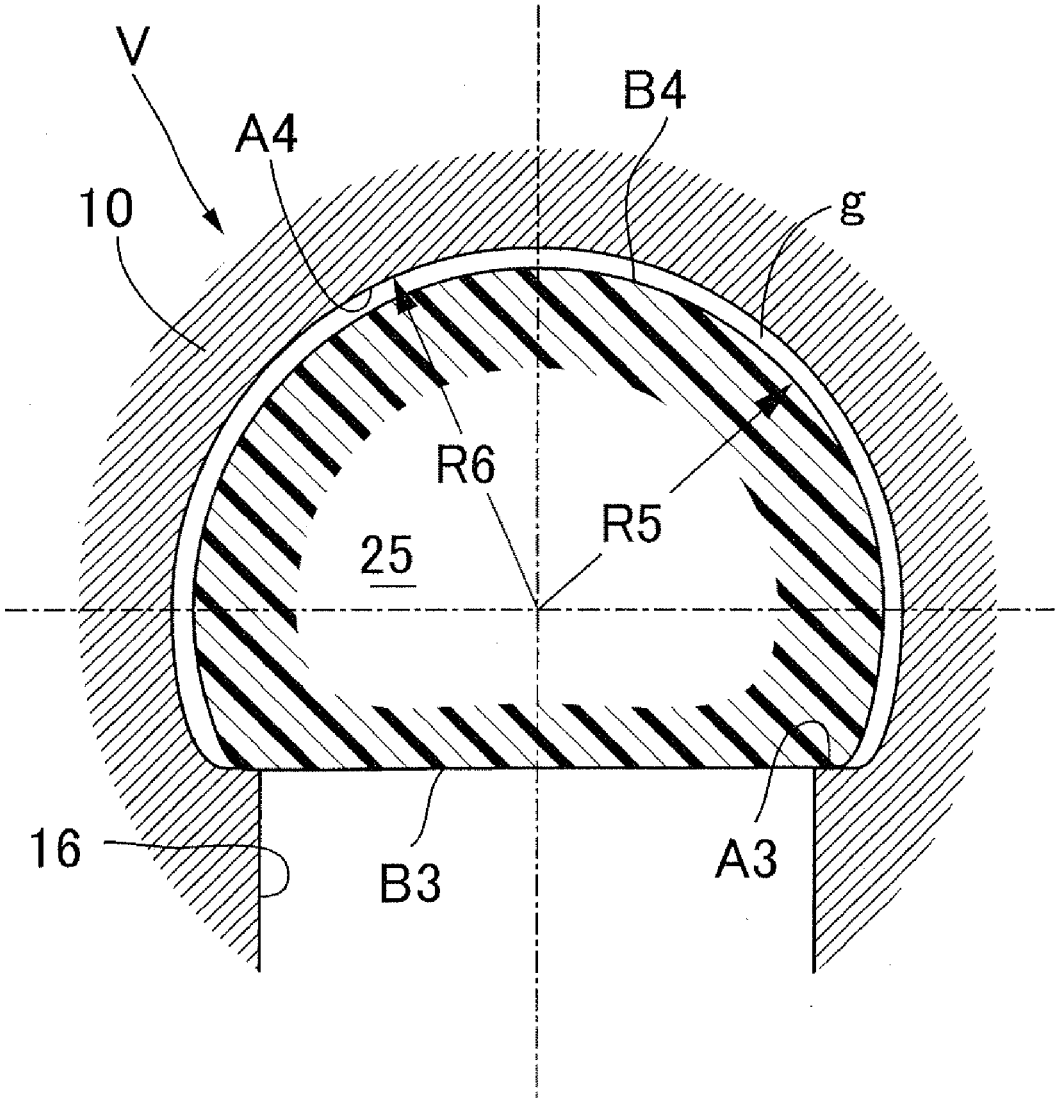
FIG. 11 is a view, corresponding to FIG. 9, showing a third embodiment of the present invention (third embodiment).

Since the arrangement is otherwise the same as that of the preceding embodiment, in FIG. 11 portions corresponding to those of the preceding embodiment are denoted by the same reference numerals and symbols, and duplication of the explanation is omitted.

Embodiment 4

Fourth and fifth embodiments of the present invention are now explained by reference to FIG. 12 and FIG. 13.

In the fourth embodiment, a valve chamber 15 and a valve body 25 are formed so as to have similar rectangular cross-sections, one flat inner side face, with an opening, of the valve chamber 15 and one flat outer side face of the valve body 25 opposing the inner side face are in intimate contact, and a gap g is provided between other opposing faces; in the fifth embodiment, a valve chamber 15 and a valve body 25 are formed so as to have similar polygonal cross-sections with all sides convex arcs, one arc-shaped face, with an opening, of the valve chamber 15 and one arc-shaped face of the valve body 25 opposing the face of the valve chamber 15 are in intimate contact, and a gap g is provided between the other opposing arc-shaped faces. In these embodiments, it is unnecessary to specially provide the valve body 25 with rotation prevention.

Figure 12:
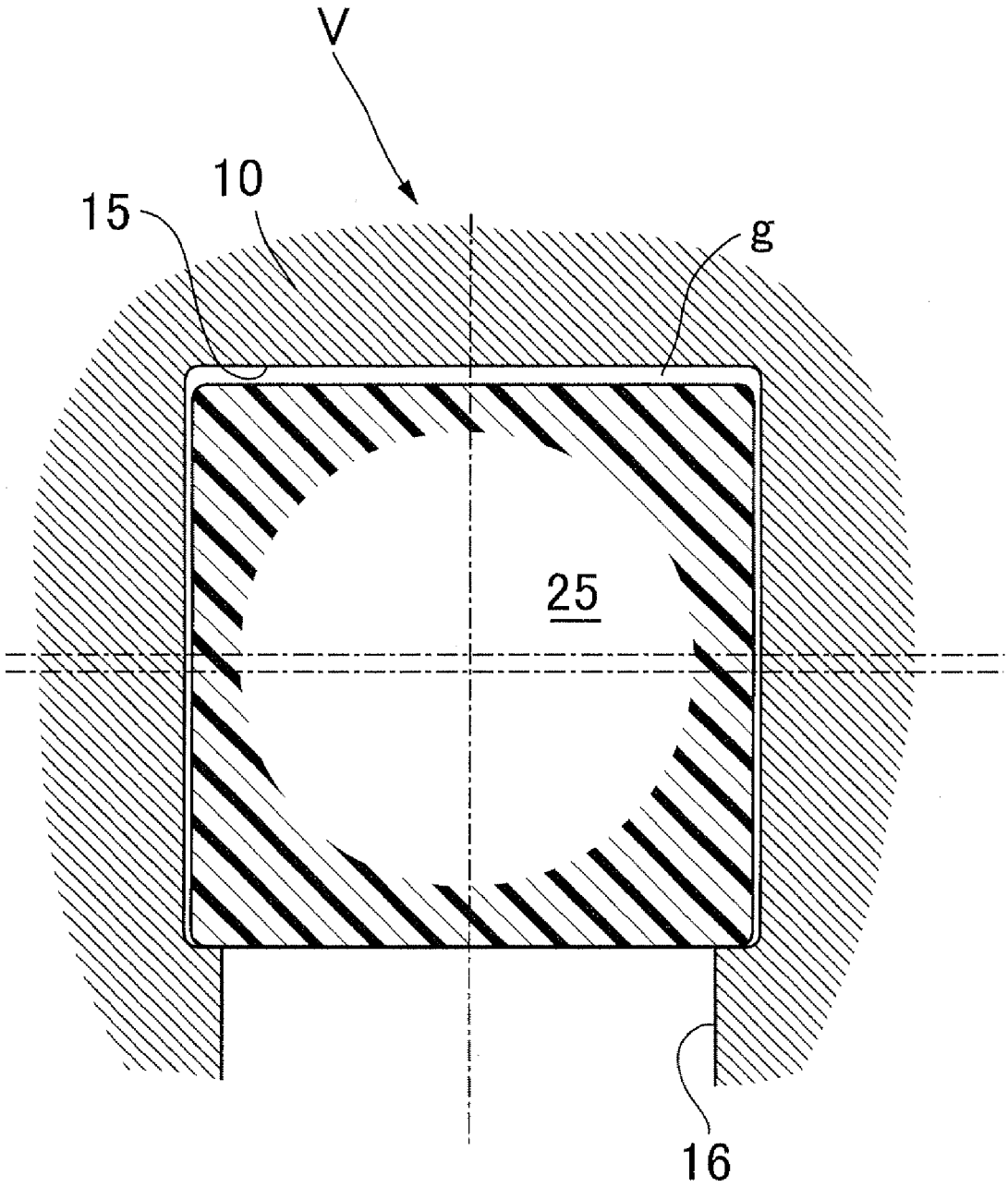
FIG. 12 is a view, corresponding to FIG. 9, showing a fourth embodiment of the present invention (fourth embodiment).
Figure 13:
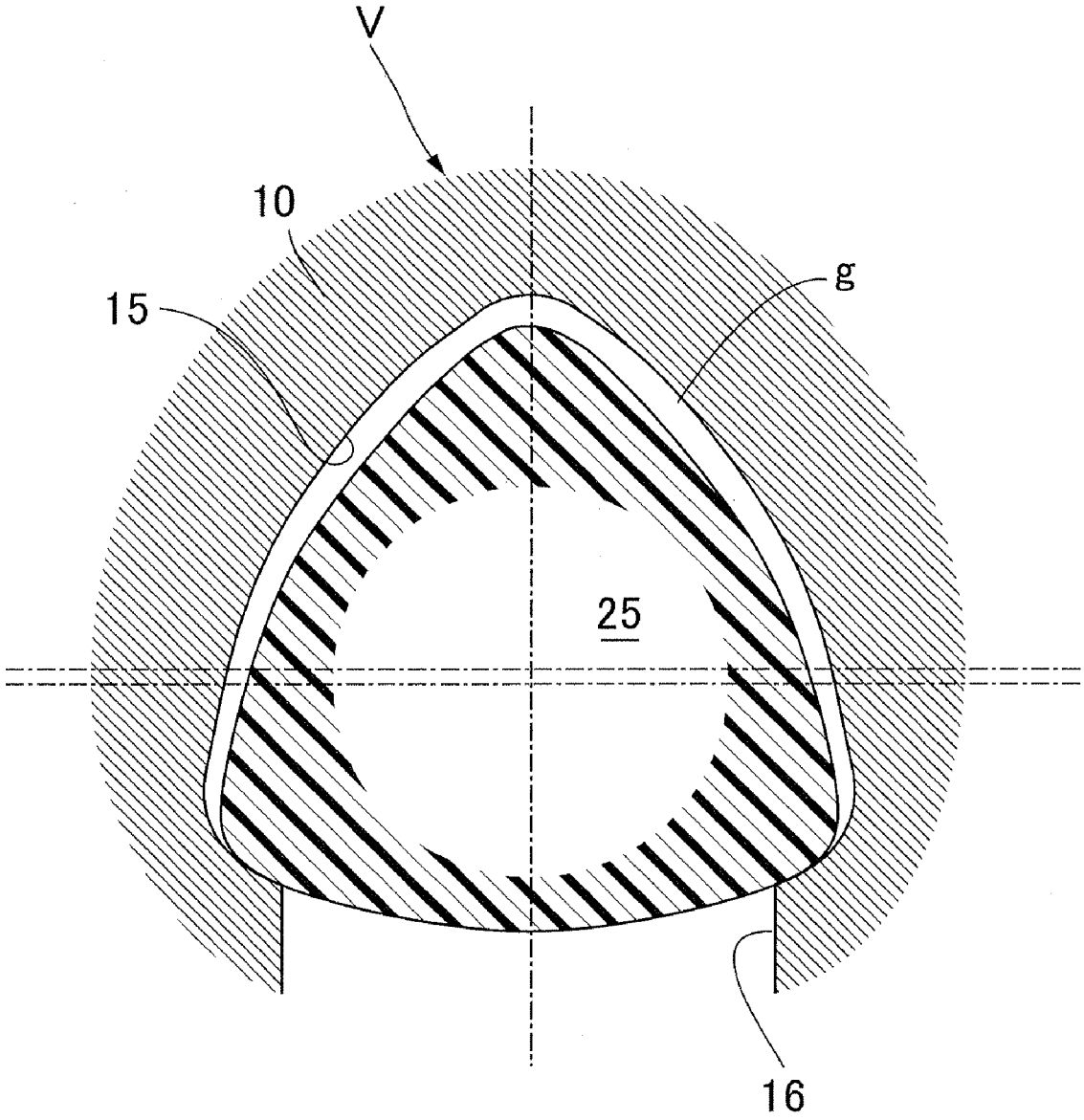
FIG. 13 is a view, corresponding to FIG. 9, showing a fifth embodiment of the present invention (fifth embodiment).

Since the arrangements are otherwise the same as that of the preceding embodiment, in FIG. 12 and FIG. 13 portions corresponding to those of the preceding embodiment are denoted by the same reference numerals and symbols, and duplication of the explanation is omitted.

Embodiment 5

Figure 14:
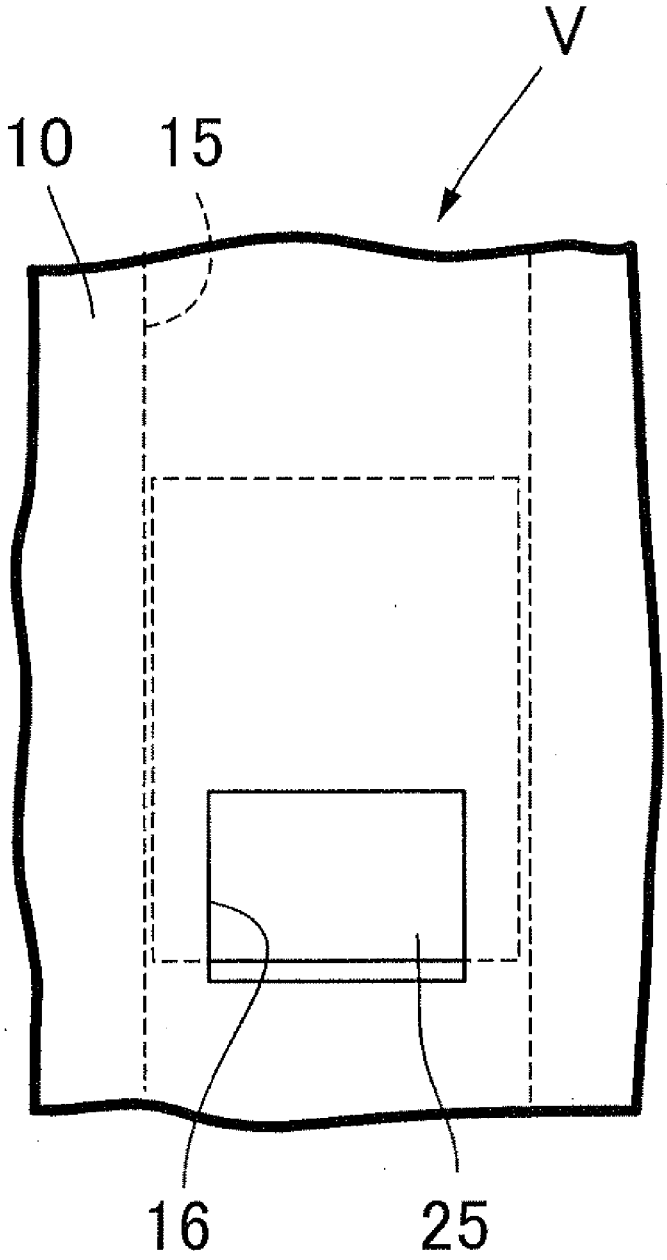
FIG. 14 is a front view of a bypass valve showing a sixth embodiment of the present invention (sixth embodiment).

Finally, a sixth embodiment of the present invention is explained by reference to FIG. 14.

The sixth embodiment is different from the first embodiment with respect to a bypass valve V. That is, a metering hole 16 is formed as a rectangle having two sides parallel to a sliding direction of a valve body 25. Since the arrangement is otherwise the same as that of the first embodiment, in FIG. 14 portions corresponding to those of the first embodiment are denoted by the same reference numerals and symbols, and duplication of the explanation is omitted.

In accordance with the sixth embodiment, the effective opening area of the metering hole 16 can be controlled linearly in proportion to the sliding stroke of the valve body 25, and, moreover, when the valve body 25 is at a high degree of opening, since fast idle air can flow at a high flow rate, it can be suitably used in a large engine.

Embodiments of the present invention are explained above, but the present invention is not limited thereto and may be modified in a variety of ways as long as the modifications do not depart from the spirit and scope of the present invention. For example, the present invention may be applied to a downdraft type throttle body having its air intake path standing vertically.

The invention claimed is:

1. An air intake device for an engine comprising:

a throttle body having an air intake path, a throttle valve that is supported on the throttle body and that opens and closes the air intake path, a bypass connected to the air intake path while bypassing the throttle valve, a bypass valve for controlling the degree of opening of the bypass, the bypass valve being formed from a tubular valve chamber having an interior thereof opening on an upstream side of the bypass and having an inner face with a metering hole opening toward a downstream side of the bypass, and a valve body that is slidably but non-rotatably fitted into the valve chamber and that opens and closes the metering hole, wherein one portion of the inner face of the valve chamber on which the metering hole opens and one portion of an outer face of the valve body opposing said one portion of the inner face and covering the metering hole are formed in the same shape so as to enable them to be in intimate contact with each other, and other portions of the inner and outer faces of the valve chamber and the valve body displaced in the peripheral direction to the opposite side to said one portions are formed so as to form a gap (g) therebetween, and wherein an inner peripheral face (A) of the valve chamber is formed as a cylindrical face, a first partial outer peripheral face (B1) of the valve body covering the metering hole is formed as an arc-shaped face having a radius of curvature (R1) that is the same as that of the inner peripheral face (A), and a second partial outer peripheral face (B2) of the valve body on the side opposite to the first partial outer peripheral face (B1) is formed as an arc-shaped face that is substantially concentric with the first partial outer peripheral face (B1) and has a radius of curvature (R2) that is smaller than the radius of curvature (R1) of the first partial outer peripheral face (B1).

2. An air intake device for an engine comprising:

a throttle body having an air intake path, a throttle valve that is supported on the throttle body and that opens and closes the air intake path, a bypass connected to the air intake path while bypassing the throttle valve, a bypass valve for controlling the degree of opening of the bypass, the bypass valve being formed from a tubular valve chamber having an interior thereof opening on an upstream side of the bypass and having an inner face with a metering hole opening toward a downstream side of the bypass, and a valve body that is slidably but non-rotatably fitted into the valve chamber and that opens and closes the metering hole, wherein one portion of the inner face of the valve chamber on which the metering hole opens and one portion of an outer face of the valve body opposing said one portion of the inner face and covering the metering hole are formed in the same shape so as to enable them to be in intimate contact with each other, and other portions of the inner and outer faces of the valve chamber and the valve body displaced in the peripheral direction to the opposite side to said one portions are formed so as to form a gap (g) therebetween, and wherein an outer peripheral face (B) of the valve body is formed as a cylindrical face, a first partial inner peripheral face (A1) of the valve chamber on which the metering hole opens is formed as an arc-shaped face with a radius of curvature (R3) that is the same as that of the outer peripheral face (B), and a second partial inner peripheral face (A2) of the valve chamber on the side opposite to the first partial inner peripheral face (A1) is formed as an arc-shaped face that is concentric with the first partial inner peripheral face (A1) and has a radius of curvature (R4) that is greater than the radius of curvature (R3) of the first partial inner peripheral face (A1).

3. The air intake device for an engine according to claim 1 or 2, wherein the metering hole is formed as a rectangle with two sides parallel to a sliding direction of the valve body.

* * * * *